US009498866B2

(12) United States Patent
Lee et al.

(10) Patent No.: US 9,498,866 B2
(45) Date of Patent: Nov. 22, 2016

(54) POLISHING PAD CLEANING WITH VACUUM APPARATUS

(71) Applicant: Applied Materials, Inc., Santa Clara, CA (US)

(72) Inventors: Christopher Heung-Gyun Lee, San Jose, CA (US); Thomas Ho Fai Li, San Jose, CA (US); Tianyu Yang, Sunnyvale, CA (US)

(73) Assignee: APPLIED MATERIALS, INC., Santa Clara, CA (US)

( * ) Notice: Subject to any disclaimer, the term of this patent is extended or adjusted under 35 U.S.C. 154(b) by 0 days.

(21) Appl. No.: 14/198,560

(22) Filed: Mar. 5, 2014

(65) Prior Publication Data

US 2014/0273763 A1 Sep. 18, 2014

Related U.S. Application Data

(60) Provisional application No. 61/792,653, filed on Mar. 15, 2013.

(51) Int. Cl.
*B24B 53/017* (2012.01)
*B24B 53/00* (2006.01)

(52) U.S. Cl.
CPC ..... *B24B 53/017* (2013.01); *B24B 53/003* (2013.01)

(58) Field of Classification Search
CPC ... B24B 53/017; B24B 53/003; B24B 57/02; B24B 53/12; B24B 57/06; B24B 49/18
USPC ..... 451/443, 444, 56, 72
See application file for complete search history.

(56) References Cited

U.S. PATENT DOCUMENTS

| | | | | |
|---|---|---|---|---|
| 5,916,010 | A * | 6/1999 | Varian et al. | 451/38 |
| 6,039,635 | A * | 3/2000 | Mitsuhashi et al. | 451/72 |
| 6,093,088 | A * | 7/2000 | Mitsuhashi et al. | 451/285 |
| 6,116,993 | A * | 9/2000 | Tanaka | 451/287 |
| 6,241,587 | B1 * | 6/2001 | Drill et al. | 451/56 |

(Continued)

FOREIGN PATENT DOCUMENTS

| | | |
|---|---|---|
| JP | 2007520083 A | 7/2007 |
| KR | 100750771 B1 | 8/2007 |

OTHER PUBLICATIONS

International Search Report and Written Opinion dated Jun. 18, 2014.

*Primary Examiner* — Robert Rose
(74) *Attorney, Agent, or Firm* — Patterson & Sheridan, LLP

(57) ABSTRACT

In one embodiment, a method for cleaning a surface of a polishing pad includes conditioning the polishing pad surface and rotating the conditioned polishing pad surface. The method also includes spraying the polishing pad surface to lift debris from the conditioned polishing pad surface. The method further includes vacuuming the debris from the polishing pad surface downstream from where the condition occurs, wherein downstream is defined by a rotational direction of the polishing pad. In another embodiment, a processing station including a rotatable platen, a substrate carrier head, a polishing fluid delivery system, a conditioner, a spray nozzle, and a vacuum system is provided. The conditioner is disposed between the substrate carrier head and the spray nozzle. The vacuum system is configured to vacuum the polishing pad surface. The vacuum system is downstream from the conditioner, defined by a rotation of the platen.

13 Claims, 3 Drawing Sheets

(56) References Cited

U.S. PATENT DOCUMENTS 6,530,827 B2 * 3/2003 Mitsuhashi ..... 451/72
6,669,538 B2 * 12/2003 Li et al. ..... 451/56
7,452,264 B2 * 11/2008 Mavliev et al. ..... 451/56
2002/0090896 A1 7/2002 Li et al.
2007/0087672 A1 4/2007 Benner
2008/0102737 A1 5/2008 Chang et al.

* cited by examiner

POLISHING PAD CLEANING WITH VACUUM APPARATUS

CROSS-REFERENCE TO RELATED APPLICATIONS

This application claims priority to U.S. Provisional Patent Application Ser. No. 61/792,653, filed on Mar. 15, 2013, which herein is incorporated by reference.

BACKGROUND OF THE INVENTION

1. Field of the Invention

Embodiments of the present invention generally relate to an apparatus for cleaning a polishing pad with a vacuum apparatus, and methods of using the same. Additionally, embodiments of the present invention also relate to a chemical mechanical planarization system for use with the vacuum apparatus.

2. Description of the Related Art

In the fabrication of integrated circuits and other electronic devices on substrates, multiple layers of conductive, semiconductive, and dielectric materials are deposited on or removed from a feature side, i.e., a deposit receiving surface, of a substrate. As layers of materials are sequentially deposited and removed, the feature side of the substrate may become non-planar and require planarization and/or polishing. Planarization and polishing are procedures where previously deposited material is removed from the feature side of the substrate to form a generally even, planar or level surface. Chemical mechanical planarization (CMP) procedures are useful in removing undesired surface topography and surface defects, such as rough surfaces, agglomerated materials, crystal lattice damage, and scratches. The procedures are also useful in forming features on a substrate by removing excess deposited material used to fill the features and to provide an even or level surface for subsequent deposition and processing. A CMP process generally includes pressing a substrate against a polishing surface of a polishing pad in the presence of a polishing media, such as a polishing fluid or slurry. Relative motion is provided between the substrate and polishing surface to planarize the surface of the substrate in contact with the pad through one or a combination of a chemical, mechanical or electrochemical process.

During polishing processes, the polishing surface of the pad that is in contact with a feature side of the substrate becomes laden with used polishing fluid and by-products from the various processes performed on the substrate (i.e., processing debris). The debris may create an unevenness in the plane of the polishing surface, as well as clogging or blocking pores present on the polishing surface, whereby reducing the ability of the pad to properly and efficiently planarize the substrate. Periodic conditioning of the polishing surface is required to maintain a consistent roughness, porosity and/or generally flat profile across the polishing surface. However, many current conditioning methods are designed to only condition the polishing surface and do not effectively remove particles or debris generated during processing, and or the conditioning process.

Therefore, there is a need for an improved method and apparatus for cleaning a polishing pad.

SUMMARY OF THE INVENTION

Embodiments of the present invention generally relate to an apparatus for cleaning a polishing pad surface with a vacuum system, and methods of using the same. In one embodiment, a method for cleaning a surface of a polishing pad is provided. The method includes conditioning the polishing pad surface and rotating the conditioned polishing pad surface. The method also includes spraying the polishing pad surface to lift debris from the conditioned polishing pad surface. The method further includes vacuuming the debris from the polishing pad surface downstream from where the condition occurs, wherein downstream is defined by a rotational direction of the polishing pad.

In another embodiment, a method for processing a substrate is provided. The method includes delivering a polishing fluid through a polishing fluid delivery arm to a surface of a polishing pad and rotating a portion of the polishing pad surface having the polishing fluid thereon. The method also includes polishing the substrate against the polishing pad surface in the presence of the polishing fluid and conditioning the polishing pad surface. The method further includes high-pressure spraying the polishing pad surface to lift debris from the polishing pad surface and vacuuming the debris. The vacuuming occurs downstream from where the conditioning occurs, wherein downstream is defined by a rotational direction of the polishing pad.

In yet another embodiment, a processing station is provided. The processing station includes a rotatable platen, a substrate carrier head, a polishing fluid delivery system, a conditioner, a spray nozzle, and a vacuum system. The substrate carrier head is configured to retain a substrate against a surface of a polishing pad disposed on the platen. The polishing fluid delivery system is configured to provide polishing fluid to the polishing pad surface. The conditioner is disposed adjacent the platen and adapted to condition the polishing pad surface. The spray nozzle is configured to provide a high-pressure water spray to the polishing pad surface. The conditioner is disposed between the substrate carrier head and the spray nozzle. The vacuum system is configured to vacuum the polishing pad surface. The vacuum system is downstream from the conditioner, defined by a rotation of the platen.

BRIEF DESCRIPTION OF THE DRAWINGS

So that the manner in which the above-recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

To facilitate understanding, identical reference numerals have been used, where possible, to designate identical elements that are common to the figures. It is contemplated that elements disclosed in one embodiment may be beneficially utilized on other embodiments without specific recitation.

DETAILED DESCRIPTION

Figure 1:
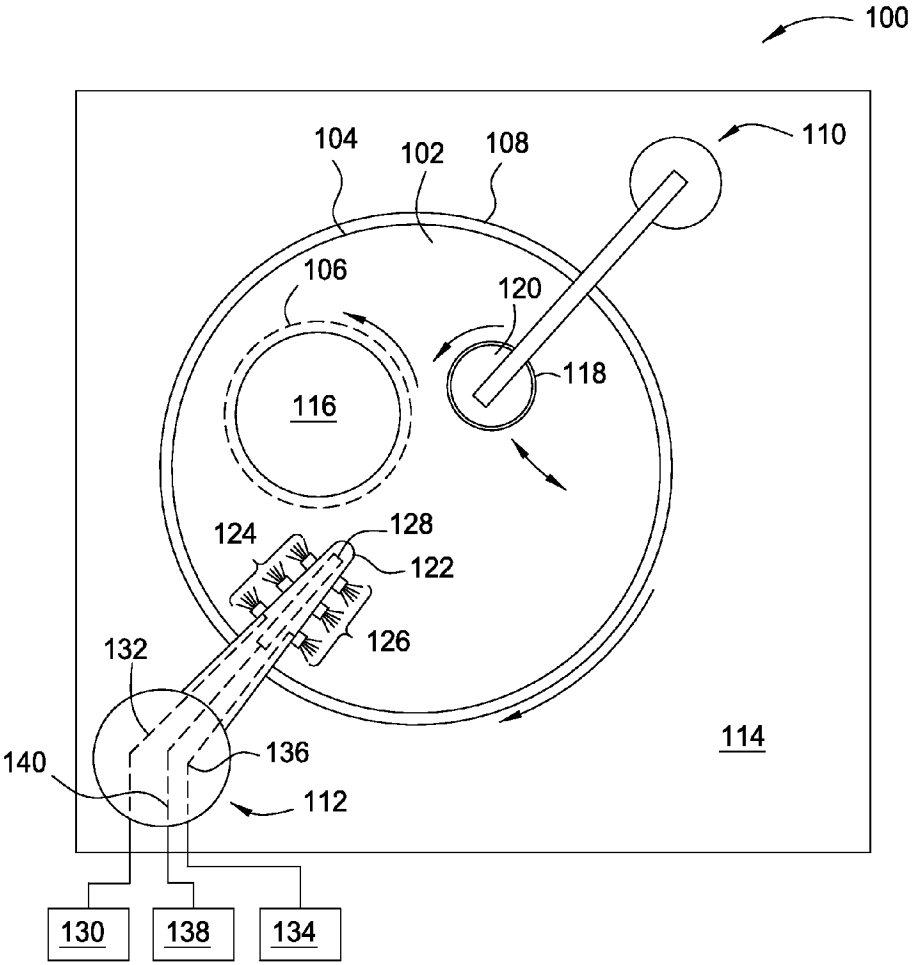
FIG. 1 is a top plan view of one embodiment of a processing station.

FIG. 1 is a top plan view of the processing station 100 that is configured to perform a polishing process, such as a CMP or electrochemical mechanical planarization (ECMP) process, while also being configured to clean a polishing surface 102 of a polishing pad 104. The processing station 100 may be a stand-alone unit or part of a larger processing system. Examples of a larger processing system that the processing station 100 may be utilized with include REFLEXION®, REFLEXION GT™, REFLEXION LK™, REFLEXION LK ECMP™, and MIRRA MESA® polishing systems, all available from Applied Materials, Inc., located in Santa Clara, Calif. It is contemplated that other processing stations may be adapted to benefit from the invention, including those from other equipment manufacturers.

The processing station 100 includes a substrate carrier head 106 (shown in phantom), a platen 108, a conditioning module 110, and a polishing fluid delivery assembly 112 (such as a slurry delivery assembly). The platen 108, the conditioning module 110 and the slurry delivery assembly 112 may be mounted to a base 114 of the processing station 100.

The platen 108 supports the polishing pad 104. The platen 108 is rotated by a motor (not show) so that the polishing pad 104 is rotated relative to a substrate 116 retained in the substrate carrier head 106 during processing. As such, terms such as upstream, downstream, in front, behind, before and after are generally to be interpreted relative to the motion or detection of the platen 108 and the polishing pad 104 supported thereon, as appropriate.

The substrate carrier head 106 is configured to retain the substrate 116 and controllably urge the substrate 116 against the polishing surface 102 of the polishing pad 104 during processing. The substrate carrier head 106 may also rotate the substrate 116 during processing.

The conditioning module 110 is configured to condition the polishing pad 104 by opening the pores of the polishing pad 104. The conditioning module 110 includes a conditioning disk 118 and a conditioning head 120. The conditioning disk 118 may be a brush having bristles made of a polymer material or may have an abrasive surface comprising abrasive particles. In one embodiment, the conditioning disk 118 is a circular disk that contains abrasive particles such as diamonds. The conditioning head 120 is configured to retain the conditioning disk 118 and controllably urge the conditioning disk 118 against the polishing surface 102 of the polishing pad 104 during conditioning.

The slurry delivery assembly 112 is configured to deliver a polishing media, such as a fluid or slurry, to the polishing pad 104 while the substrate 116 is polished on the polishing surface 102. As on skilled in the art would understand, the polishing pad 104 may include any features that would retain the polishing media, e.g. pores and/or polishing pad grooves found in the polishing pad 104. The slurry delivery assembly 112 includes a slurry delivery arm 122 which may be located in front of or behind the substrate carrier head 106. The slurry delivery arm 122 includes one or more slurry nozzles 124 and one or more spray nozzles 126. In the embodiment shown in FIG. 1, the slurry delivery arm 122 also includes a vacuum assembly 128 disposed in the slurry delivery arm. The slurry nozzles 124 are coupled to a polishing fluid source 130 by a delivery line 132 and configured to deliver a polishing fluid, such as slurry, to the polishing surface 102. The spray nozzles 126 are coupled to a water or deionized water source 134 by a delivery line 136 and configured to deliver high-pressure water spray to the polishing surface 102 to lift the debris off of the polishing surface 102. In one embodiment, the slurry nozzles 124 and the spray nozzles 126 are disposed in the slurry delivery arm 122. The debris may comprise by-products from the various processes performed on the substrate and the condition process. In one embodiment, the slurry delivery arm 122 having the slurry nozzle 124, the spray nozzle 126 and the vacuum assembly 128 are located in the same angular position (as shown in FIG. 1).

Figure 2:
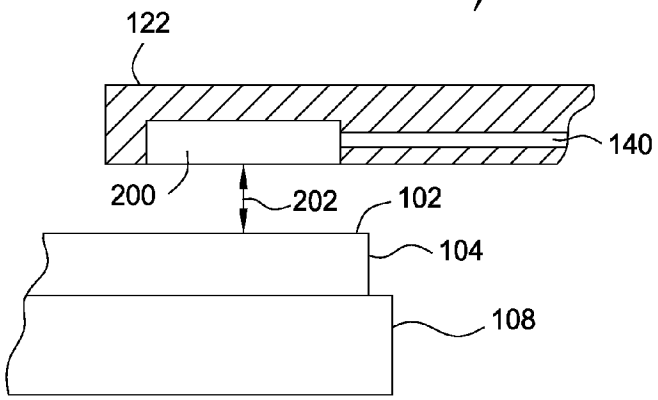
FIG. 2 is a partial side view of a vacuum assembly having a polishing pad disposed below the vacuum assembly.

FIG. 2 is a partial sectional view of the vacuum assembly 128. Referring to FIGS. 1 and 2, the vacuum assembly 128 includes a vacuum port 200 coupled to a vacuum source 138 by a delivery line 140. The vacuum port 200 is configured to vacuum the polishing surface 102, at an adjustable distance 202 between the vacuum port 200 and the polishing surface 102. The vacuum assembly 128 is configured to remove debris from the polishing surface 102.

Referring back to FIG. 1, the slurry delivery arm 122 is adapted to move the nozzles 124, 126 and the vacuum assembly 128 from an edge of the polishing pad 104 diameter to at least a portion of the radius of the polishing pad 104 in a linear, arcing or sweeping motion. The movement of the arm 122 may be configured such that the entire surface of the polishing pad is vacuumed.

Additionally, the location of the processing station 100 elements provides a beneficial order for conditioning and cleaning the polishing surface 102. The substrate carrier head 106 is located directly downstream of the slurry delivery arm 122 and directly upstream of the conditioning module 110. The slurry nozzles 124 of the slurry delivery arm 122 are located adjacent the substrate carrier head 106 to provide polishing media to the polishing surface 102 just upstream of the substrate 116 prior to polishing. Similarly, the conditioning module 110 is beneficially located downstream of the substrate carrier head 106 to condition the polishing surface 102 immediately after the substrate has been polished on the polishing surface 102, and located between the substrate carrier head 106 and the spray nozzles 126. The spray nozzles 126 are located downstream of the conditioning module 110, and located between the conditioning module 110 and the vacuum assembly 128. The vacuum assembly 128 is located downstream of the spray nozzles 126, and located between the slurry nozzles 124 and the spray nozzles 126. The spray nozzles 126 provide a jet of high pressure water to the conditioned polishing surface 102 which lifts debris from the polishing surface 102 after the polishing pad 104 has been conditioned, and thus allows for the vacuum assembly 128 to immediately remove debris from the polishing pad 104 prior to delivery of additional polishing media thereto. Since the spray nozzles 126 are located between the conditioning module 110 and the vacuum assembly 128, any abrasives coming loose from the conditioning module 110 and embedded into the polishing pad 104 may be loosened and dislodged from the pad 104 by the high pressure jets prior to vacuuming, thereby allowing the vacuum assembly 128 to make more efficient removal of debris from the pad 104. In contrast, conventional system having vacuums proximate the conditioning module and upstream of any high pressure water sprays systems do not effectively remove hard to remove debris from the pad since the pad has been vacuumed prior to debris effectively being dislodged from the pad surface.

Figure 3:
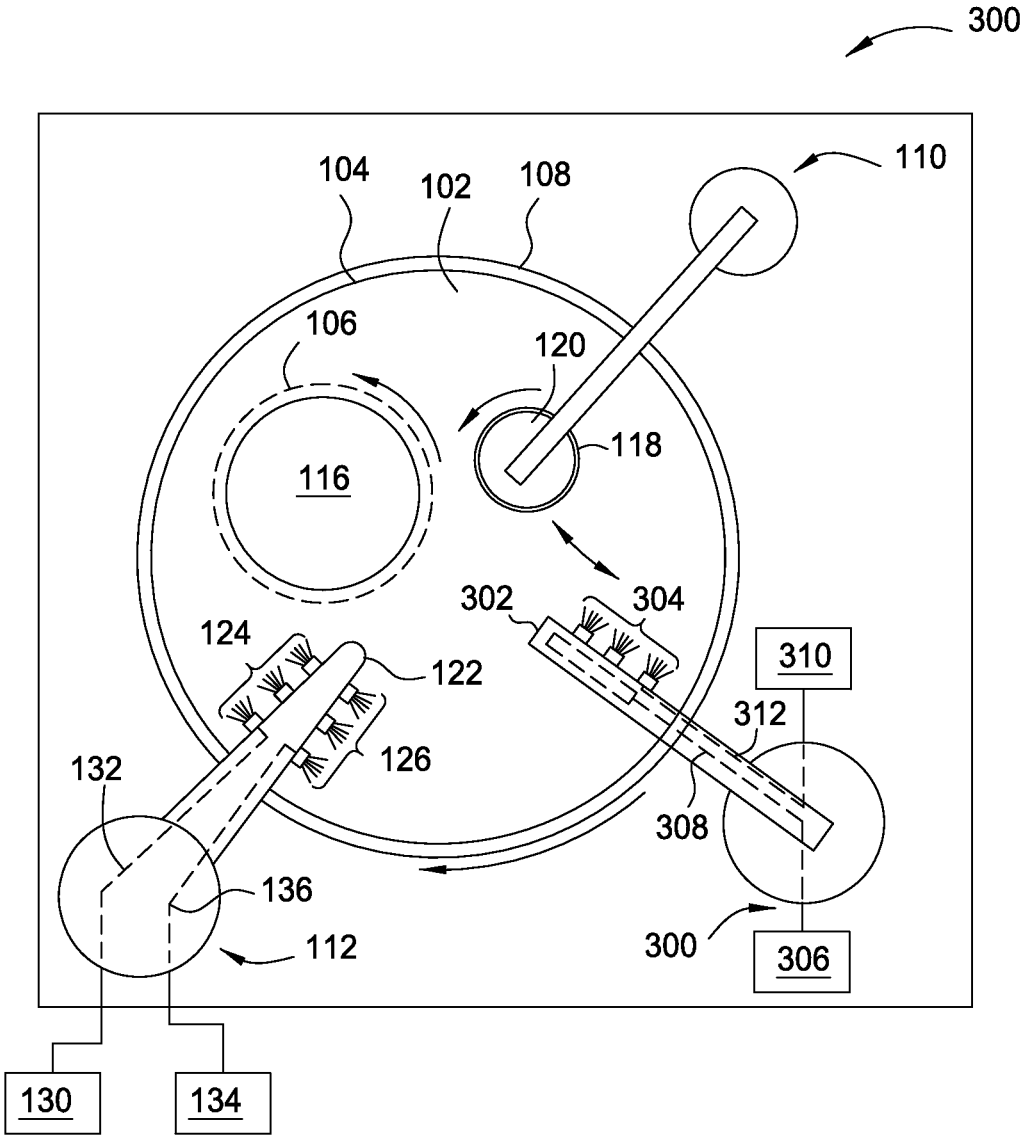
FIG. 3 is a top plan view of one embodiment of a processing station.

FIG. 3 is a top plan view of another embodiment of the processing station 100 that is configured to perform a polishing process, such as a CMP or electrochemical mechanical planarization (ECMP) process. In the embodiment shown in FIG. 3, the processing station 100 includes a stand-alone vacuum assembly 300 configured to remove debris from the polishing surface 102. The stand-alone vacuum assembly 300 includes a vacuum delivery head 302 and one or more spray nozzles 304. The vacuum delivery head 302 includes the vacuum port 200 (shown in FIG. 2) coupled to a vacuum source 306 by a delivery line 308. The one or more spray nozzles 304 are coupled to a high-pressure water or deionized water source 310 by a delivery line 312, and the spray nozzles 304 are configured to spray the polishing pad surface 102 to lift the debris off the polishing surface 102. The conditioning module 110 is disposed between the substrate carrier head 106 and the vacuum assembly 300. The vacuum assembly 300 is configured to remove the debris from the polishing surface 102 by vacuuming the polishing surface 102. Additionally the vacuum assembly 300 is adapted to move the vacuum delivery head 302 and the nozzles 304 from an edge of the polishing pad 104 to at least a portion of the radius of the polishing pad 104 in a linear, arcing or sweeping motion, as discussed above As discussed above, the location of the processing station 100 elements provides a beneficial order for conditioning and cleaning the polishing surface 102. Specifically, the vacuum delivery head 302 is advantageously located downstream of the spray nozzles 126, which are downstream of the conditioning module 110, thereby allow more efficient removal of debris from the polishing pad 104. Locating the vacuum delivery head 302 within the slurry delivery arm 122 minimizes the number of modules present on the processing station 100, thereby providing a cost effective solution to pad cleaning while preparing a cleaned polishing surface 102 for the next substrate to be polished.

Figure 4:
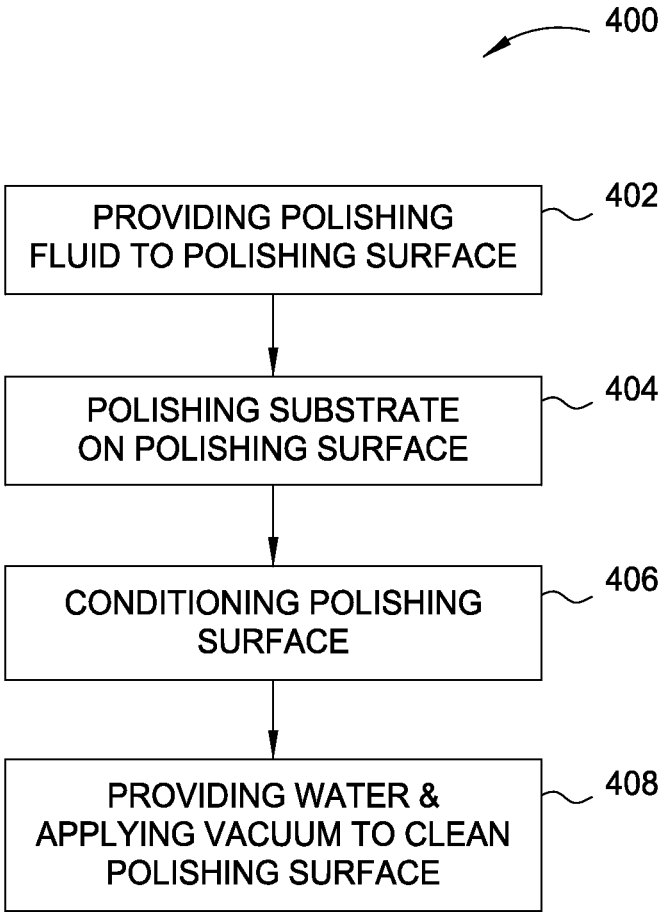
FIG. 4 is a flow diagram of a method of polishing a substrate.

FIG. 4 is a flow diagram of a method 400 for polishing substrates. It should be noted that the sequence of the method discussed below is not intended to be limiting as to the scope of the invention described herein, since one or more elements of the sequence may be added, deleted and/or reordered without deviating from the basic scope of the invention.

At block 402 the method may begin by providing polishing media, such as slurry, through the slurry nozzles 124 of the slurry delivery arm 122 to the polishing surface 102 at a location downstream of the vacuum assembly 128, relative to the rotation of the polishing pad 104. The location is defined a region between the vacuum assembly and the substrate carrier head 106. At block 404, the substrate carrier head 106 urges the substrate 116 towards the polishing surface 102 to be polished in the presence of the slurry. At block 406, the conditioning module 110 then conditions the polishing surface 102 of the polishing pad 104 as discussed above, or by other suitable conditioning techniques.

At block 408, water is sprayed at a high-pressure to the polishing surface 102 through the spray nozzles 126 or spray nozzles 304. In one embodiment, the water is sprayed at a location upstream of the vacuum assembly 128 or vacuum assembly 300, relative to the rotation of the polishing pad 104. The location is defined as a region between the conditioning module 110 and the substrate carrier head 106, relative to the rotation of the polishing pad. Advantageously, the high-pressure water loosens and lifts the particles and debris present on the polishing surface. The polishing surface 102 is vacuumed through the vacuum assembly 128 or the vacuum assembly 300 to remove the recent water containing the lifted debris from the polishing surface 102. The polishing surface 102 is vacuumed at a location downstream of the conditioning module 110 and the spray nozzles 126 or spray nozzles 304, relative to the rotation of the polishing pad 104. In one embodiment, the location is defined as a region between the spray nozzles 126 and the substrate carrier head 106, the spray nozzles 304 and the substrate carrier head 106. In another embodiment, the location is defined as a region between the slurry nozzles 124 and the spray nozzles 126, or between the slurry nozzles 124 and the spray nozzles 304. In one embodiment, the vacuuming may be performed prior to or after polishing the substrate 116. However, in other embodiments, polishing and/or conditioning processes in the processing stations 100 or 300 are stopped or halted while the high-pressure water spray and the vacuum is applied to the polishing surface. Close proximity of the vacuum assembly 128, 300 to the spray nozzles 126 provides for quick and efficient and cleaning of the polishing surface 102, and therefore reduces the associated polishing downtime. Additionally, the conditioning module is upstream of the high-pressure spray nozzles and the vacuum assemblies. This beneficially prevents costly slurry from being inadvertently treated as debris and vacuumed from the polishing surface 102.

Thus, the polishing surface 102 is advantageously removed of particles and debris from polishing processes and subsequent polishing of substrates is enhanced. While the foregoing is directed to embodiments of the invention, other and further embodiments of the invention may be devised without departing from the basic scope thereof.

What is claimed is:

1. A method for cleaning a surface of a polishing pad, comprising:

conditioning the polishing pad surface;

rotating the conditioned polishing pad surface;

spraying the polishing pad surface to lift debris from the conditioned polishing pad surface from a vacuum assembly that is movable in a linear or arcing motion over the polishing pad surface; and vacuuming the lifted debris from the polishing pad surface downstream from where the spraying and conditioning occurs using the vacuum assembly, defined by a rotational direction of the polishing pad.

2. The method of claim 1, wherein the spraying comprises:

spraying fluid on the polishing pad surface downstream from where the conditioning occurs.

3. The method of claim 1, wherein the vacuuming is not performed while applying a polishing fluid to the polishing pad surface.

4. The method of claim 1, further comprising:

adjusting a distance between the polishing pad surface and a vacuum port.

5. A method for processing a substrate, comprising:

delivering a polishing fluid through a polishing fluid delivery arm to a surface of a polishing pad, the polishing fluid delivery arm being movable in a plane that is parallel to a plane of the surface of the polishing pad;

rotating a portion of the polishing pad surface having the polishing fluid thereon;

polishing the substrate against the polishing pad surface in the presence of the polishing fluid;

conditioning the polishing pad surface;

high-pressure spraying, using the polishing fluid delivery arm, the polishing pad surface to lift debris from the polishing pad surface; and vacuuming, after the high-pressure spraying, using the polishing fluid delivery arm, the debris from the polishing pad surface downstream from where the conditioning occurs, defined by a rotational direction of the polishing pad.

6. The method of claim 5, wherein the high-pressure spraying comprises:

spraying fluid onto a region of the polishing pad surface defined between a conditioner for the conditioning and a vacuum system for the vacuuming.

7. The method of claim 5, wherein the vacuuming comprises:

vacuuming a region of the polishing pad surface defined between a conditioner for the conditioning and spray nozzles for the high-pressure spraying.

8. The method of claim 5, wherein the vacuuming is not performed while delivering the polishing fluid, polishing the substrate, and conditioning the polishing pad surface.

9. The method of claim 5, wherein the vacuuming comprises:

vacuuming prior to or after the polishing.

10. A processing station comprising:

a rotatable platen;

a substrate carrier head configured to retain a substrate against a surface of a polishing pad disposed on the platen;

a polishing fluid delivery arm configured to provide polishing fluid to the polishing pad surface, the polishing fluid delivery arm being movable in a plane that is parallel to a plane of the surface of the polishing pad;

a conditioner disposed adjacent the platen, wherein the conditioner is adapted to condition the polishing pad surface; and a vacuum assembly disposed on the polishing fluid delivery arm and having a spray nozzle and a vacuum system that is movable with the polishing fluid delivery arm over the surface of the polishing pad, wherein:

the spray nozzle is configured to provide a high-pressure water to spray the polishing pad surface, wherein the conditioner is disposed between the substrate carrier head and the spray nozzle; and the vacuum system is configured to vacuum the polishing pad surface after the spray from the spray nozzle, wherein the vacuum system includes a vacuum port that is spaced away from the polishing pad surface and is in a position downstream from the conditioner, defined by a rotational direction of the platen.

11. The processing station of claim 10 further comprising:

a polishing fluid nozzle configured to provide the polishing fluid to the polishing pad surface, and wherein the vacuum system is disposed between the spray nozzle and the polishing fluid nozzle.

12. The processing station of claim 10, wherein a distance between the vacuum system and the polishing pad surface is adjustable.

13. The processing station of claim 10, wherein the polishing fluid delivery arm is configured to move the spray nozzle and the vacuum system from an edge of the polishing pad to at least a portion of the radius of the polishing pad in a linear, arcing or sweeping motion.

* * * * *